US006588408B2

(12) United States Patent
Bedwell et al.

(10) Patent No.: US 6,588,408 B2
(45) Date of Patent: Jul. 8, 2003

(54) CYLINDER LINER FOR DIESEL ENGINES WITH EGR AND METHOD OF MANUFACTURE

(75) Inventors: Tom Bedwell, Ann Arbor, MI (US); Miguel Azevedo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/954,810

(22) Filed: Sep. 18, 2001

(65) Prior Publication Data

US 2003/0051713 A1 Mar. 20, 2003

(51) Int. Cl.[7] ..... F02B 75/08
(52) U.S. Cl. ..... 123/668
(58) Field of Search ..... 29/888.061; 123/668, 123/193.2, 41.84, 669

(56) References Cited

U.S. PATENT DOCUMENTS

| | | | | |
|---|---|---|---|---|
| 3,657,078 A | | 4/1972 | Schweikher | |
| 3,749,072 A | * | 7/1973 | Schweikher | 123/193.2 |
| 3,896,009 A | | 7/1975 | Kobayashi et al. | |
| 3,932,228 A | | 1/1976 | Sugiyama et al. | |
| 4,409,947 A | * | 10/1983 | Yanagihara et al. | 123/568.11 |
| 4,495,907 A | | 1/1985 | Kamo | |
| 4,678,738 A | | 7/1987 | Shimizu et al. | |
| 4,974,498 A | | 12/1990 | Lemelson | |
| 5,287,621 A | | 2/1994 | Usui | |
| 5,466,360 A | | 11/1995 | Ehrsam et al. | |
| 5,566,450 A | | 10/1996 | Rao et al. | |
| 5,660,704 A | | 8/1997 | Murase | |
| 5,980,722 A | | 11/1999 | Kuroda et al. | |
| 6,508,240 B1 | * | 1/2003 | Bedwell et al. | 123/668 |

FOREIGN PATENT DOCUMENTS

| | | | | |
|---|---|---|---|---|
| JP | 58-144656 A | * | 8/1983 | 123/193.6 |

* cited by examiner

*Primary Examiner*—Willis R. Wolfe
*Assistant Examiner*—Hyder Ali
(74) *Attorney, Agent, or Firm*—Howard & Howard

(57) ABSTRACT

A ferrous cylinder liner for use in diesel engines having exhaust gas recirculation (EGR) is protected from corrosive attack from the EGR environment by first final machining the inner running surface of the liner and thereafter plating the finished inner surface with a thin, non-porous, continuous coating of chromium which serves as a barrier to the EGR gases. The liner is installed and used in its as-coated condition with no post-coating finishing of the coated surface.

7 Claims, 1 Drawing Sheet

CYLINDER LINER FOR DIESEL ENGINES WITH EGR AND METHOD OF MANUFACTURE

BACKGROUND OF THE INVENTION

1. Technical Field

Figure 1:
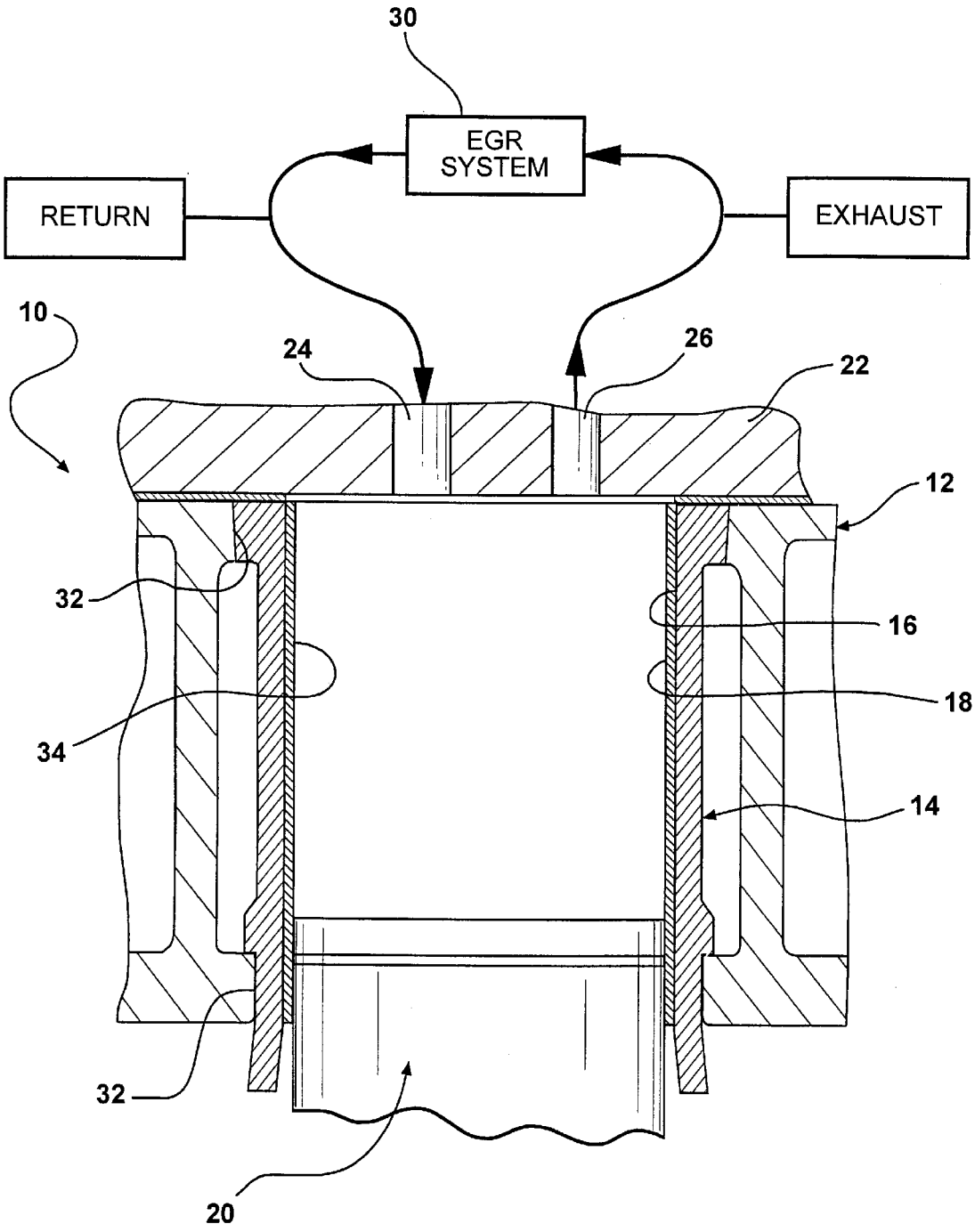

The present invention relates generally to cylinder liners for diesel engine applications and to methods of their manufacture.

2. Related Art

It is anticipated that government regulations will soon require the recirculation of exhaust gases in diesel engines, which would present a much more corrosive, acidic operating environment for engine liners than that presently experienced in diesel engines. Many current ferrous cylinder lines would be prone to corrosive attack under EGR conditions. While it is not uncommon to coat cylinder liners with a metallic wear surface, such coatings are typically post-plate honed or finished to achieve the desired, final surface finish. However, such honing or finishing of the coating surface would likely disturb the coating, impairing its effectiveness as a barrier in a diesel EGR environment.

It is an object of the present invention to provide a cylinder liner and method of its manufacture which is resistant to corrosion in diesel engine EGR operating conditions.

SUMMARY OF THE INVENTION

A method according to the invention of manufacturing a cylinder liner for a diesel engine having an exhaust gas recirculation system (EGR) comprises fabricating a cylinder liner of ferrous metal having an inner surface and finishing the inner surface to the desired final surface finish for guiding the piston. After final finishing, a continuous, non-porous EGR barrier coating of chromium is applied to the finished inner surface, and the liner is operated in an EGR environment of a diesel engine without any post-bonding machining of the metallic EGR coating.

The invention has the advantage of providing a barrier coating to an otherwise conventional ferrous liner that enables the liner to operate in a corrosive EGR environment of a diesel engine without being adversely affected by the environment.

The invention has the further advantage of providing a simple solution to the problem of how to protect a ferrous liner in an EGR diesel engine environment. In particular, the invention provides a post-machined coating to the otherwise final-finished liner. The coating is continuous and non-porous and is presented in its as-coated condition to the EGR environment. Eliminating any postcoating machining of the EGR coating ensures that the coating remains continuous and non-porous and is not disturbed so as to impair its barrier properties to the EGR environment.

Another advantage offered by the invention is its simplicity in addressing the problem. The invention recognizes that careful attention to the process steps, the selection of the coating material and the preservation of the coating once applied, provides a simple but effective barrier for protecting a ferrous liner from the EGR environment of a diesel engine.

The invention further simplifies the process of manufacturing cylinder liners by eliminating any post-coating finishing operations on the coating. Once coated, the liner is ready to be installed in a diesel engine. The final finish of the inner surface of the liner and careful attention to the application of the coating provides the coated liner with the desired running surface without having to disturb the coating after it is applied.

THE DRAWINGS

These and other features and advantages of the present invention will become more readily appreciated when considered in connection with the following detailed description and appended drawing, wherein:

The sole drawing FIG. 1 is a diagrammatic fragmentary cross-sectional view of a diesel engine with EGR shown fitted with a cylinder liner constructed according to the invention.

DETAILED DESCRIPTION

A diesel engine assembly 10 has a cylinder block 12 and a plurality of ferrous cylinder liners 14 therein.

Prior to installing the cylinder liners 14 in the cylinder block 12, each cylinder liner 14 is fabricated to include an internal surface 16 having a metallic EGR coating 18 bonded thereto. The metallic coating 18 serves as a barrier which protects the ferrous liner material from attack by the corrosive EGR environment. The inner coated surface 16 of the liners 14 provides a running surface for guiding a reciprocating piston 20.

The cylinder block 12 mounts a cylinder head 22 which has an intake port 24 and an exhaust port 26. Exhaust gases exiting the exhaust port 26 are processed through an exhaust gas recirculation (EGR) system 30 which re-directs at least a portion of uncombusted exhaust gases back into the cylinder through the intake port 24 for combustion. The returned exhaust vapor is characteristically acidic and corrosive to ferrous cylinder liners, but is prevented from attacking the cylinder liners 14 by provision of the metallic barrier coating 18.

The ferrous liners 14 are prepared by final-finishing the inner surfaces 16 prior to applying the EGR barrier coating 18. The final-finishing is of such character that, once coated with the barrier coating 18, the inner surfaces 16 need no further machining or finishing before the liners 14 are put to use in operation in the engine. It will be appreciated by those skilled in the art that different liner applications may call for different surface finishes of the liners, and thus "final finish" as used herein is meant to convey the level of finishing which is acceptable for a given application following application of the coating 18. Generally, however, the final finish of the liners 16 prior to coating, preferably have a surface finish in the range Rz=2.9 to Rz=5.3, and more preferably in the range of 3.9–4.2Rz.

As explained above, it is only after the inner surfaces 16 are final finished that the barrier coating 18 is applied preferably by honing the inner surface. The coating 18 is preferably a chromium coating which is electroplate bonded onto the surfaces 16. The coating 18 is non-porous and continuous such that the underlying ferrous liner material is fully shielded from exposure to the EGR environment by the overlying coating material 18. The chromium material is resistant to corrosive attack by the EGR environment.

The coating 18 is preferably thin such that the inner surface 16 of the liners 14 can be final machined to near-net dimension and then plated with the coating 18 to substantially retain and reflect the surface finish through the coating 18 and keep the inner surface 16 within the desired dimensional tolerance. The coating 18 preferably has a thickness of between 5–50 $\mu$m and more preferably between 10–25 $\mu$m.

After the coating 18 is applied, no further machining or finishing of the coated surface is conducted, so as to retain the continuous non-porous, thin, EGR resistant character of the coating 18.

Following coating, the liner is installed in the block 12 and put into operation in its as-coated condition.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A method of manufacturing a cylinder liner for a diesel engine having exhaust gas recirculation (EGR), comprising:

fabricating a ferrous cylinder liner having an inner surface;

final finishing the inner surface to a predetermined surface finish; and after final finishing, bonding a continuous, non-porous, metallic EGR barrier coating consisting of chromium directly on the inner surface and operating the liner without any post-bonding finishing of the metallic EGR coating.

2. The method of claim 1 wherein the inner surface is finished by a honing operation.

3. The method of claim 1 wherein the metallic EGR coating is bonded by electroplating.

4. The method of claim 1 wherein the metallic EGR coating is applied to a thickness of between 5 $\mu$m–50 $\mu$m.

5. A method of manufacturing a cylinder liner for a diesel engine having exhaust gas recirculation (EGR), comprising:

fabricating a ferrous cylinder liner having an inner surface;

final finishing the inner surface; and electroplating the inner surface directly with a coating of continuous, non-porous chromium to a thickness between 10 $\mu$m–25 $\mu$m and operating the liner with the chromium coating in the as-electroplated condition with no post-plate finishing of the chromium coating.

6. A diesel engine having exhaust gas recirculation, comprising:

a diesel engine block;

a ferrous liner disposed in said block, said liner having an inner surface with a final surface finish; and a continuous, non-porous chromium coating electroplated directly onto said final finished inner surface of said liner, said coating having an as-plated surface finish.

7. A cylinder liner for a diesel engine having exhaust gas recirculation, comprising:

a ferrous cylinder liner body having an inner surface which is final finished to guide a reciprocating piston; and a continuous, non-porous chromium coating electroplated directly onto said final finished inner surface and ready for use in its as-plated condition.

* * * * *